US009933230B1

(12) United States Patent
Combs, II

(10) Patent No.: US 9,933,230 B1
(45) Date of Patent: Apr. 3, 2018

(54) ARCHERY BOW MEASURING DEVICE

(71) Applicant: James M. Combs, II, Beaver Creek, OH (US)

(72) Inventor: James M. Combs, II, Beaver Creek, OH (US)

( * ) Notice: Subject to any disclaimer, the term of this patent is extended or adjusted under 35 U.S.C. 154(b) by 147 days.

(21) Appl. No.: 15/151,646

(22) Filed: May 11, 2016

Related U.S. Application Data

(60) Provisional application No. 62/164,633, filed on May 21, 2015.

(51) Int. Cl.
*B43L 13/04* (2006.01)
*F41B 5/14* (2006.01)

(52) U.S. Cl.
CPC ..... *F41B 5/148* (2013.01)

(58) Field of Classification Search
CPC ..... F41B 5/148
USPC ..... 33/265, 486, 494
See application file for complete search history.

(56) References Cited

U.S. PATENT DOCUMENTS 3,969,825 A * 7/1976 Mathes ..... F41H 5/14 124/90
4,382,339 A * 5/1983 Saunders ..... G01B 5/0023 33/265
4,594,786 A * 6/1986 Rezmer ..... G01B 5/0023 33/265
2008/0176681 A1* 7/2008 Donahoe ..... F41B 5/1403 473/570
2009/0032004 A1* 2/2009 Jones ..... F41B 5/14 124/86
2014/0083406 A1* 3/2014 Bednar ..... F41B 5/1415 124/91
2014/0366860 A1* 12/2014 Naki ..... F41B 5/148 124/86
2015/0024880 A1* 1/2015 Pedersen ..... F41B 5/1488 473/575

* cited by examiner

*Primary Examiner* — G. Bradley Bennett
(74) *Attorney, Agent, or Firm* — Donald J. Ersler

(57) ABSTRACT

An archery bow measuring device preferably includes a support tube, an extension spring, a measuring tab, a length recording insert and a string nock. The support tube includes a measuring slot formed from one end to substantially a middle of the support tube. A plurality of measurement graduations are formed adjacent the measuring slot. The measuring tab and the length recording insert are slidably retained in the measuring slot. One end of the extension spring is retained in an opposing end of the support tube. An opposing end of the extension spring is attached to the measuring tab. The archery bow measuring device is placed on an arrow support rest of an archery bow and a bow string is inserted into the string nock. The user retracts the string to a maximum draw length. The measuring tab will push the length recording insert to a length along the measuring slot.

18 Claims, 6 Drawing Sheets

ARCHERY BOW MEASURING DEVICE

CROSS-REFERENCES TO RELATED APPLICATIONS

This is a utility patent application taking priority from provisional application No. 62/164,633 filed on May 21, 2015.

BACKGROUND OF THE INVENTION

1. Field of the Invention

The present invention relates generally to archery and more specifically to an archery bow measuring device, which allows a single user to measure a draw length of their archery bow.

2. Discussion of the Prior Art

It appears that the prior art does not disclose an archery bow measuring device.

Accordingly, there is a clearly felt need in the art for an archery bow measuring device, which allows a single user to measure a draw length of their archery bow.

SUMMARY OF THE INVENTION

The present invention provides an archery bow measuring device, which allows a single user to measure a draw length of their archery bow. The archery bow measuring device preferably includes a support tube, an extension spring, a measuring tab, a length recording insert and a string nock. The support tube includes a measuring slot formed from one end to substantially a half a length of the support tube. A width of the measuring slot is less than the inner diameter of the support tube. A plurality of measurement graduations are formed adjacent the measuring slot. The extension spring includes a loop leg formed on one end and a hook leg formed on an opposing end thereof. The measuring tab includes a support pin and an arrow tab. The arrow tab extends outward from an end of the support pin. A spring hole is formed through an end of the support pin. The support pin is sized to be slidably received by an inner perimeter of the support tube. The length recording insert includes an outer curved ring, an inner curved ring and a connection portion. The inner curved ring extends from a bottom of the connection portion and the outer curved ring extends from a top of the connection portion. A tube gap is formed between the inner curved ring and the outer curved ring. The tube gap is sized to slidably receive a thickness of a support tube wall. The string nock includes a tube plug and a notch portion. The tube plug extends from one end of the notch portion and a string slot is formed in an opposing end of the notch portion to receive a bow string.

The archery bow measuring device is preferably assembled in the following manner. The hook leg end of the extension spring is inserted into the opposing end of the support tube with a pulling device (not shown), such as a wire attached to the hook loop. The extension spring is pulled through the support tube 10 with the pulling device. A spring pin is inserted through the support tube and the loop leg. The tube plug of the string nock is then inserted into the opposing end of the support tube. The support pin of the measuring tab is inserted into the measuring slot and pushed near an end of the measuring slot. The hook leg is pulled through the inner perimeter of the support tube with the pulling device and the hook leg is inserted into the spring hole in the support pin. The connection portion of the length recording insert is pushed into the measuring slot, until thereof is in contact with the arrow tab. An end plug is inserted into the one end of the support tube to prevent the length recording insert from exiting the support tube.

In use, the archery bow measuring device is placed on an arrow support rest of an archery bow and the bow string is inserted into the string nock. The user retracts the bow string to a maximum draw length. The measuring tab will push the length recording insert to a length along the measuring slot. The bow string is released and the archery bow measuring device removed from the arrow support rest. The length recording insert will remain in place and a measurement of the string draw length is provided by viewing a position of the length recording insert relative to the measurement graduations on the outside surface of the support tube.

Accordingly, it is an object of the present invention to provide an archery bow measuring device, which allows a single user to measure a draw length of their archery bow.

These and additional objects, advantages, features and benefits of the present invention will become apparent from the following specification.

DETAILED DESCRIPTION OF THE PREFERRED EMBODIMENTS

Figure 1:
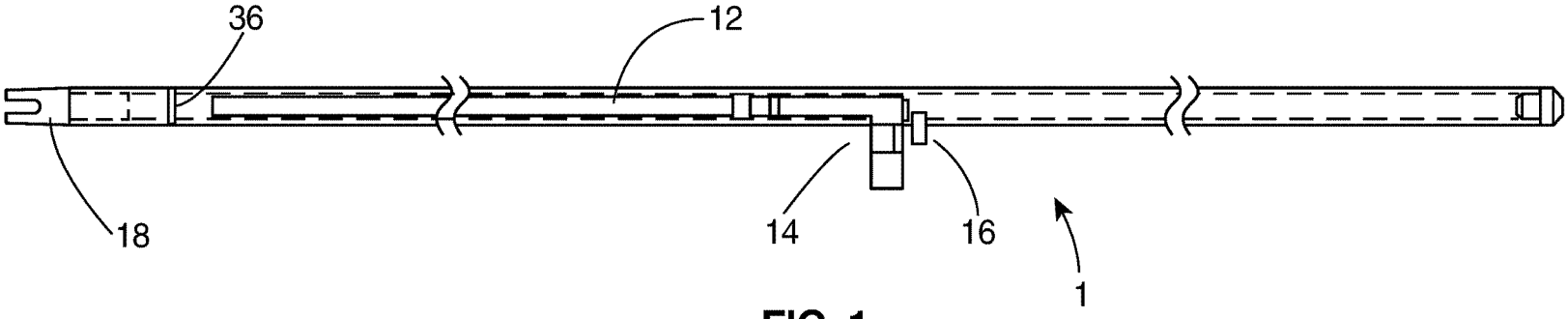
FIG. 1 is a top view of an archery bow measuring device in accordance with the present invention.
Figure 2:
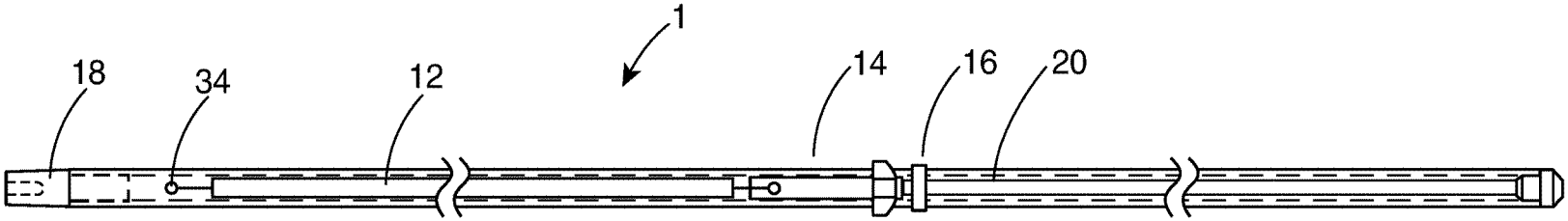
FIG. 2 is a side view of an archery bow measuring device in accordance with the present invention.
Figure 3:
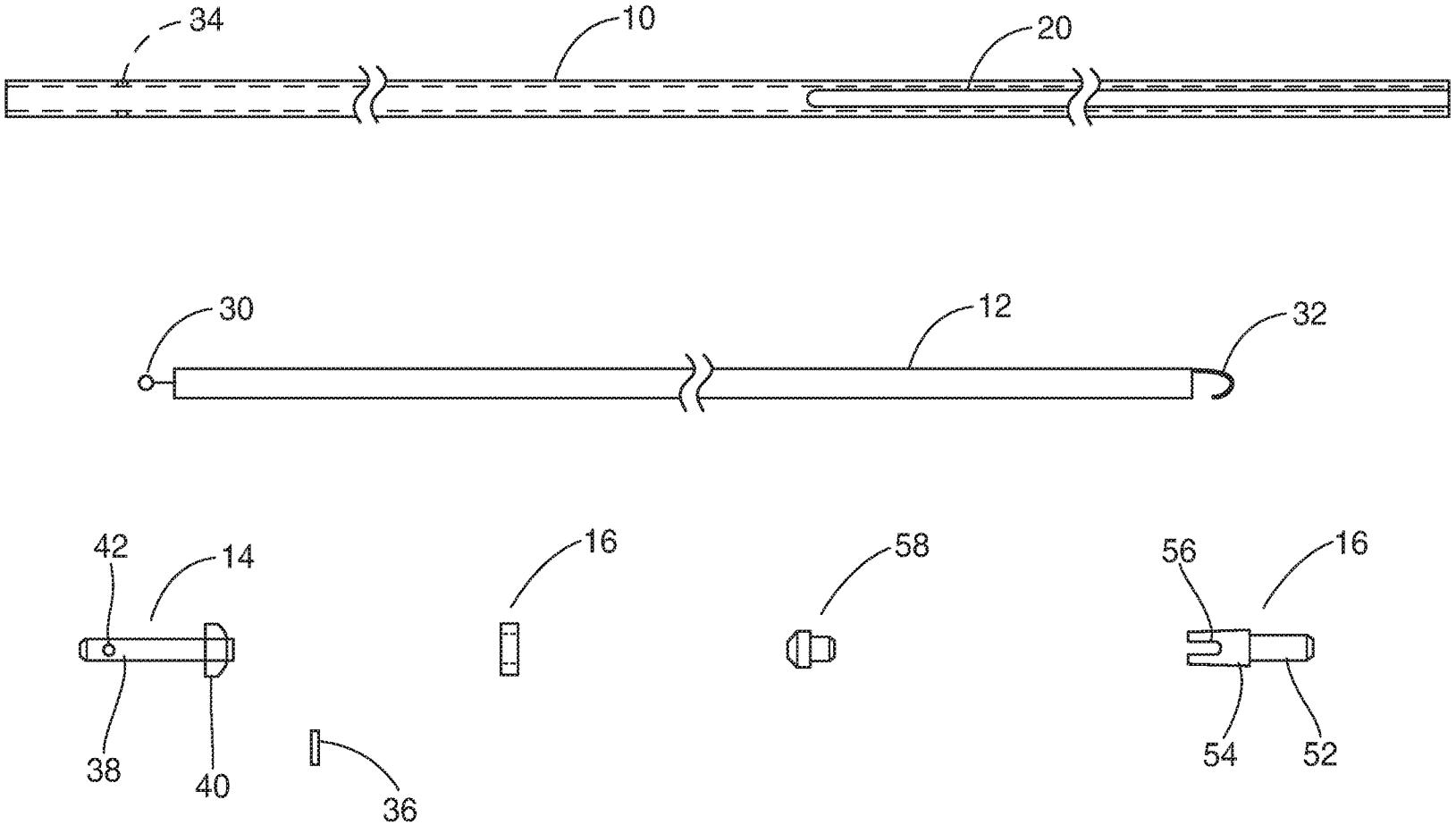
FIG. 3 is an exploded side view of an archery bow measuring device in accordance with the present invention.
Figure 4:
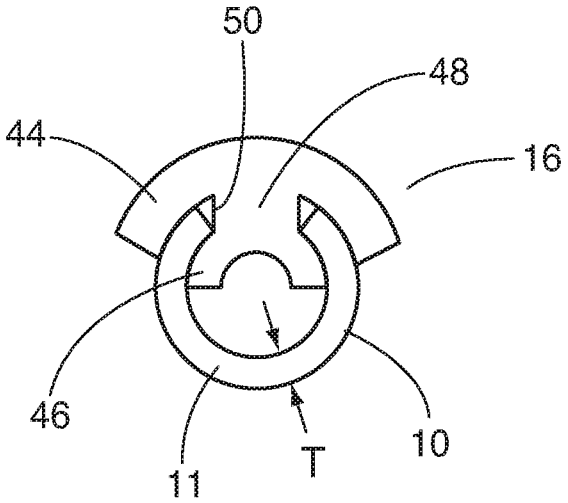
FIG. 4 is an end view of a length recording insert retained in a support tube of an archery bow measuring device in accordance with the present invention.
Figure 5:
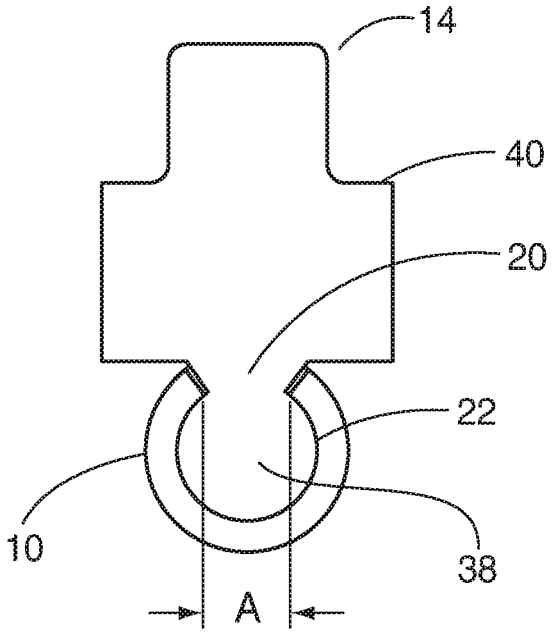
FIG. 5 is an end view of a measuring tab retained in a support tube of an archery bow measuring device in accordance with the present invention.
Figure 6:
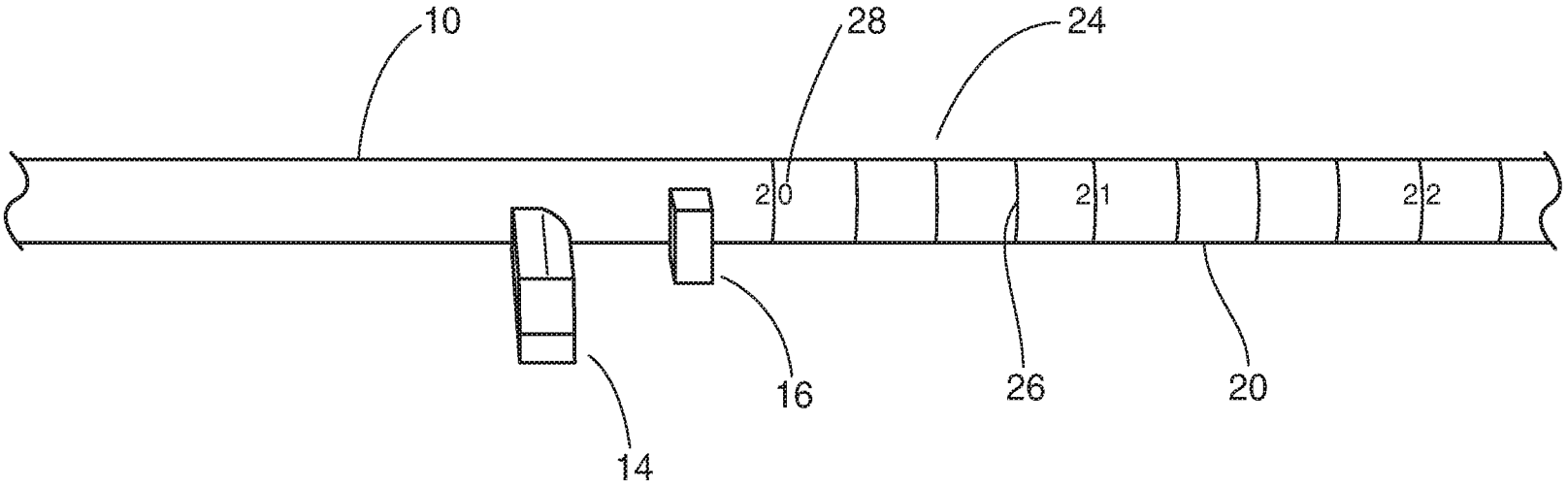
FIG. 6 is an enlarged perspective view of an archery bow measuring device illustrating a plurality of measurement graduations in accordance with the present invention.

With reference now to the drawings, and particularly to FIG. 1, there is shown a top view of an archery bow measuring device 1. With reference to FIGS. 2-3, the archery bow measuring device 1 preferably includes a support tube 10, an extension spring 12, a measuring tab 14, a length recording insert 16 and a string nock 18. The support tube 10 includes a measuring slot 20 formed from one end to substantially a half a length of the support tube 10. With reference to FIGS. 4-5, a width "A" of the measuring slot 20 is less than the inner diameter 22 of the support tube 10. With reference to FIG. 6, a plurality of measurement graduations 24 are formed adjacent the measuring slot 20. The measurement graduations 24 include engraved lines 26 and measurement numbers 28. The extension spring 12 includes a loop leg 30 formed on one end and a hook leg 32 formed on an opposing end thereof. A pin hole 34 is formed through an opposing end of the support tube 10. A spring pin 36 is inserted through the pin hole 34 and the loop leg 30 to retain the extension spring 12.

Figure 7:
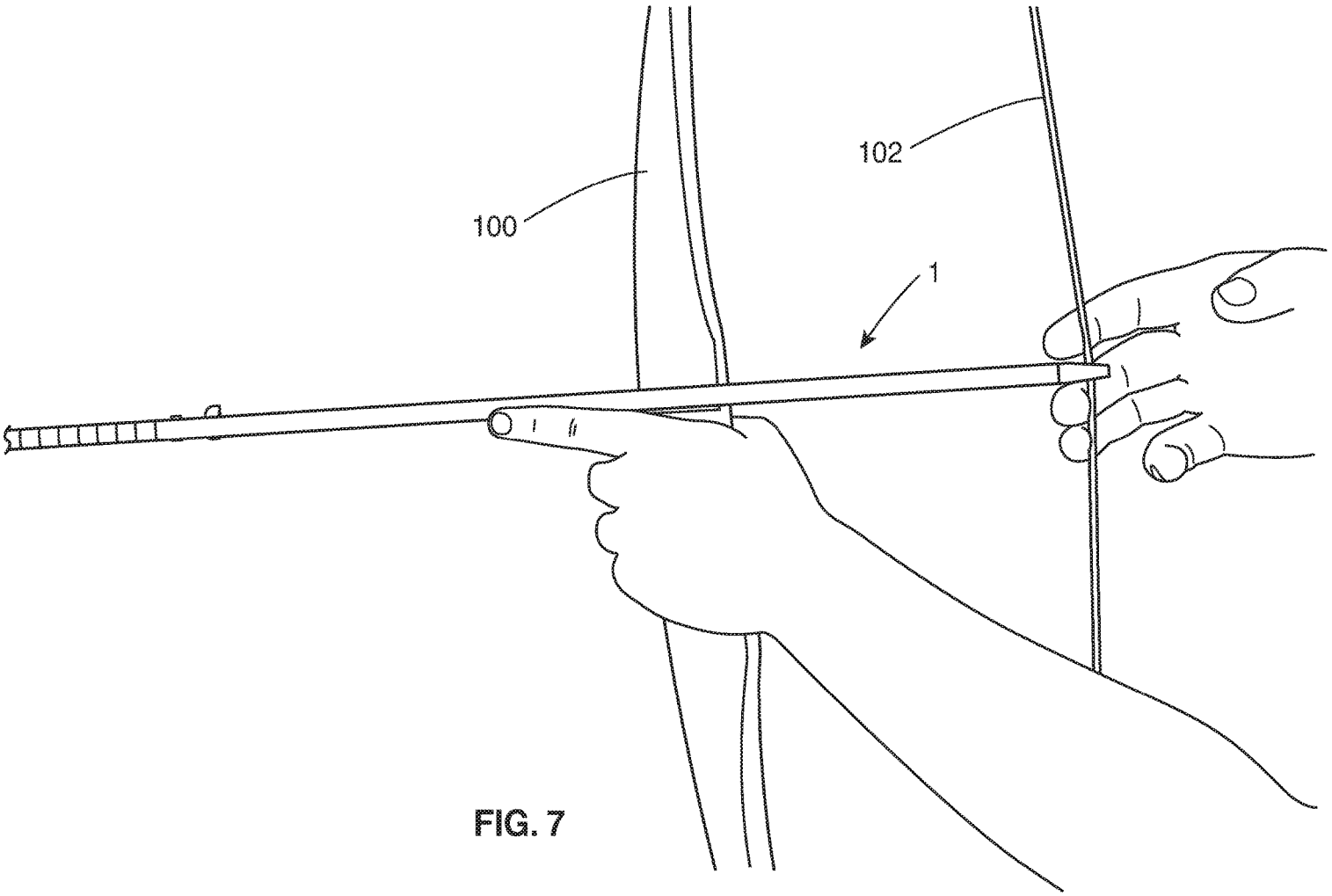
FIG. 7 is a perspective side view of an archery bow measuring device with a bow string retained in a string nock of an archery bow in accordance with the present invention.

The measuring tab 14 preferably includes a support pin 38 and an arrow tab 40. The arrow tab 40 extends outward from an end of the support pin 38. The support pin 38 is sized to be slidably received by the inner perimeter 22 of the support tube 10. A spring hole 42 is formed through an end of the support pin 38. The spring hole 42 is sized to receive the hook leg 32 of the extension spring 12. The length recording insert 16 includes a outer curved ring 44, an inner curved ring 46 and a connection portion 48. The inner curved ring 46 extends from a bottom of the connection portion 48 and the outer curved ring 44 extends from a top of the connection portion 48. A tube gap 50 is formed between the inner curved ring 46 and the outer curved ring 48. The tube gap 50 is sized to slidably receive a thickness "T" of a support tube wall 11. The string nock 18 includes a tube plug 52 and a notch portion 54. With reference to FIG. 7, the tube plug 52 extends from one end of the notch portion 54 and a string slot 56 is formed in an opposing end of the notch portion 54 to receive a bow string 102 of an archery bow 100.

The archery bow measuring device 1 is preferably assembled in the following manner. The hook leg 32 end of the extension spring is inserted into the opposing end of the support tube 10 with a pulling device (not shown), such as a wire attached to the hook leg 32. The extension spring 12 is pulled through the support tube 10, until the loop leg 30 is aligned with the pin hole 34. The spring pin 36 is inserted through the pin hole 34 and the loop leg 30. The hook leg 32 is pulled into the measure slot 20 and pushed into the spring hole 42 in the measuring tab 14. The support pin 38 of the measuring tab 40 is inserted into the measuring slot 20 and pushed near an end of the measuring slot 20. The hook leg 32 is pulled through the inner perimeter 22 of the support tube 10 with the pulling device and the hook leg 32 is inserted into the spring hole 42 in the measuring tab 14. The connection portion 48 of the length recording insert 16 is pushed into the measuring slot 20, until thereof is in contact with the arrow tab 40. An end plug 58 is inserted into the one of the support tube 10 to prevent the length recording insert 16 from exiting the support tube 10.

Figure 8:
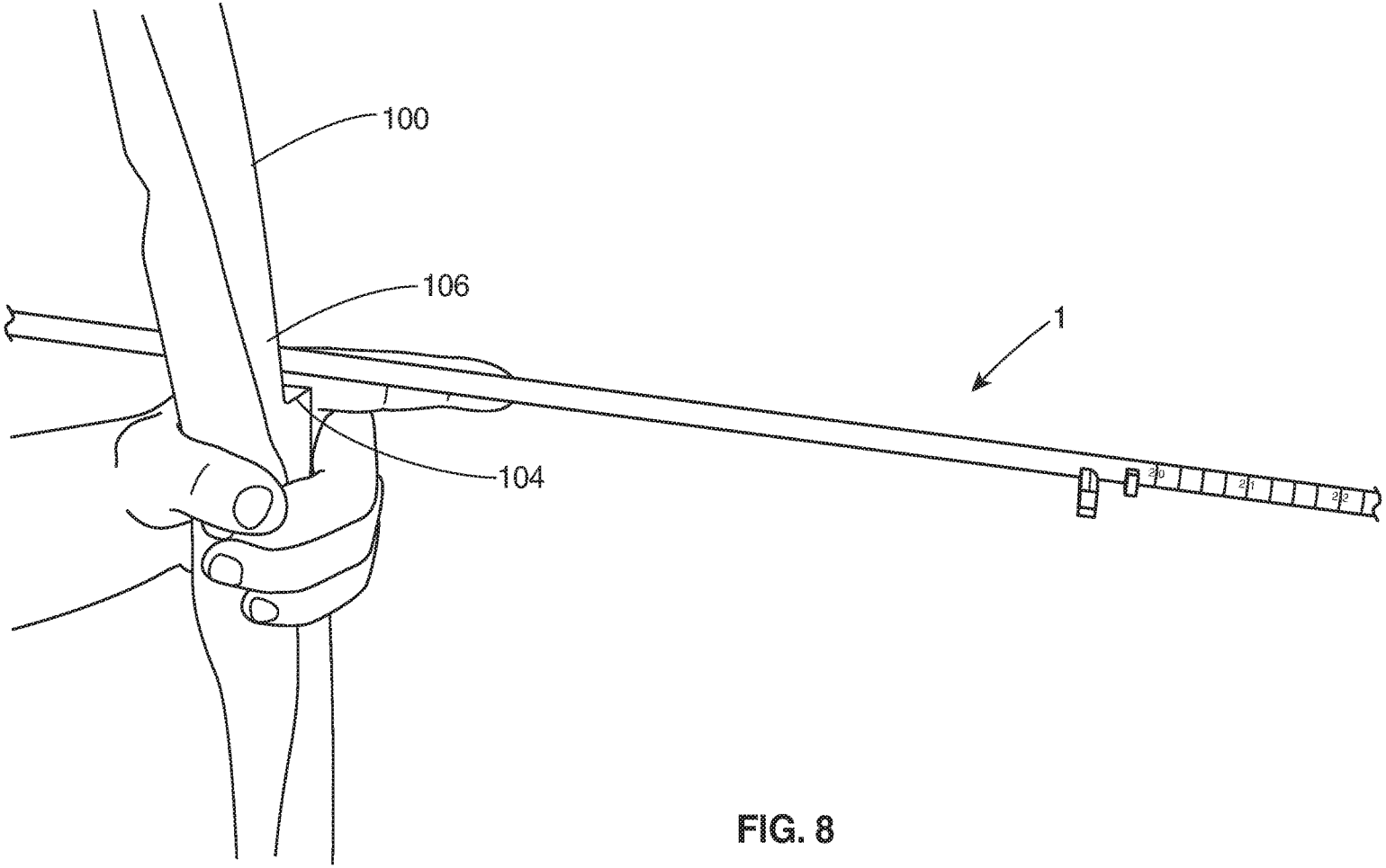
FIG. 8 is a perspective side view of an archery bow measuring device resting on an arrow rest of an archery bow in accordance with the present invention.

With reference to FIG. 8, the archery bow measuring device 1 is placed on an arrow support rest 104 of the archery bow 100 and the bow string 102 is inserted into the string nock 18. The user retracts the bow string 102 to a maximum draw length. The arrow tab 40 makes contact with a riser 106 of the archery bow 100. The measuring tab 14 will push the length recording insert 16 to a length along the measuring slot 20. The bow string 102 is released and the archery bow measuring device 1 removed from the arrow support rest 104. The length recording insert 16 will remain in place and a measurement of the string draw length is provided by viewing a position of the length recording insert 16 relative to the measurement graduations 24 on the outside surface of the support tube 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An archery bow measuring device comprising:

a support tube includes a measuring slot extending from one end to substantially a half a length of said support tube, a plurality of measurement graduations are formed adjacent said measuring slot;

an extension spring is anchored near an opposing end of said support tube;

a measuring tab is slidably retained in said measurement slot, an opposing end of said extension spring is secured to said measuring tab;

a length recording insert is slidably retained in said measuring slot;

a string nock is retained in said opposing end of said support tube, said string nock includes a string slot, wherein said archery bow measuring device is placed on an arrow rest of an archery bow, a bow string of the archery bow is inserted into said string slot, the bow string is fully retracted and then released, said length recording insert is aligned adjacent said plurality of measurement graduations to provide a string draw length.

2. An archery bow measuring device of claim 1 wherein:

said measuring tab includes a support pin and an arrow tab, said arrow tab extends outward from an end of said support pin, said support pin is sized to be received by said support tube.

3. An archery bow measuring device of claim 1 wherein:

said length recording insert includes a outer curved ring, an inner curved ring and a connection portion, said inner curved ring extends from a bottom of said connection portion, said outer curved ring extends from a top of said connection portion, a tube gap is formed between said inner curved ring and said outer curved ring, said tube gap is sized to slidably receive a thickness of a wall of said support tube.

4. An archery bow measuring device of claim 1 wherein:

an end plug is inserted into said one end of said support tube.

5. An archery bow measuring device of claim 1 wherein:

said extension spring includes a loop leg extending from one end and a hook leg extending from an opposing end thereof.

6. An archery bow measuring device of claim 5 wherein:

a spring pin is inserted through said support tube and said loop leg to anchor said extension spring to said support tube.

7. An archery bow measuring device comprising:

a support tube includes a measuring slot extending from one end to substantially a half a length of said support tube, a plurality of measurement graduations are formed adjacent said measuring slot;

an extension spring is anchored near an opposing end of said support tube;

a measuring tab includes a support pin and an arrow tab, said support pin is slidably retained in said measurement slot, an opposing end of said extension spring is secured to said measuring tab;

a length recording insert is slidably retained in said measuring slot;

a string nock is retained in said opposing end of said support tube, said string nock includes a string slot, wherein said archery bow measuring device is placed on an arrow rest of an archery bow, a bow string of the archery bow is inserted into said string slot, the bow string is fully retracted and then released, said length recording insert is aligned adjacent said plurality of measurement graduations to provide a string draw length.

8. An archery bow measuring device of claim 7 wherein:

said arrow tab extends outward from an end of said support pin, said support pin is sized to be received by said support tube.

9. An archery bow measuring device of claim 7 wherein:

said length recording insert includes a outer curved ring, an inner curved ring and a connection portion, said inner curved ring extends from a bottom of said connection portion, said outer curved ring extends from a top of said connection portion, a tube gap is formed between said inner curved ring and said outer curved ring, said tube gap is sized to slidably receive a thickness of a wall of said support tube.

10. An archery bow measuring device of claim 7 wherein:

an end plug is inserted into said one end of said support tube.

11. An archery bow measuring device of claim 7 wherein:

said extension spring includes a loop leg extending from one end and a hook leg extending from an opposing end thereof.

12. An archery bow measuring device of claim 7 wherein:

a spring pin is inserted through said support tube and said loop leg to anchor said extension spring to said support tube.

13. An archery bow measuring device comprising:

a support tube includes a measuring slot extending from one end to substantially a half a length of said support tube, a plurality of measurement graduations are formed adjacent said measuring slot, said support tube includes an inner perimeter;

an extension spring is anchored near an opposing end of said support tube;

a measuring tab includes a support pin and an arrow tab, said support pin is slidably retained in said measurement slot and said inner perimeter, an opposing end of said extension spring is secured to said measuring tab;

a length recording insert is slidably retained in said measuring slot;

a string nock is retained in said opposing end of said support tube, said string nock includes a string slot, wherein said archery bow measuring device is placed on an arrow rest of an archery bow, a bow string of the archery bow is inserted into said string slot, the bow string is fully retracted and then released, said length recording insert is aligned adjacent said plurality of measurement graduations to provide a string draw length.

14. An archery bow measuring device of claim 13 wherein:

said arrow tab extends outward from an end of said support pin.

15. An archery bow measuring device of claim 13 wherein:

said length recording insert includes a outer curved ring, an inner curved ring and a connection portion, said inner curved ring extends from a bottom of said connection portion, said outer curved ring extends from a top of said connection portion, a tube gap is formed between said inner curved ring and said outer curved ring, said tube gap is sized to slidably receive a thickness of a wall of said support tube.

16. An archery bow measuring device of claim 13 wherein:

an end plug is inserted into said one end of said support tube.

17. An archery bow measuring device of claim 13 wherein:

said extension spring includes a loop leg extending from one end and a hook leg extending from an opposing end thereof.

18. An archery bow measuring device of claim 13 wherein:

a spring pin is inserted through said support tube and said loop leg to anchor said extension spring to said support tube.

* * * * *